US007168439B2

(12) United States Patent
Patel et al.

(10) Patent No.: US 7,168,439 B2
(45) Date of Patent: Jan. 30, 2007

(54) COLLAPSIBLE GAZEBO FRAME WITH INDEPENDENT CANOPY SUPPORT

(75) Inventors: Arvin Patel, Sunnyvale, CA (US); Sungho Kim, Xiamen (CN)

(73) Assignee: North Pole Limited, Kowloon (HK)

( * ) Notice: Subject to any disclaimer, the term of this patent is extended or adjusted under 35 U.S.C. 154(b) by 418 days.

(21) Appl. No.: 10/661,161

(22) Filed: Sep. 12, 2003

(65) Prior Publication Data

US 2005/0055948 A1 Mar. 17, 2005

(51) Int. Cl.
*E04H 15/50* (2006.01)

(52) U.S. Cl. ..... 135/131; 135/145; 135/146

(58) Field of Classification Search ..... 135/131, 135/145, 146
See application file for complete search history.

(56) References Cited

U.S. PATENT DOCUMENTS

| | | | | |
|---|---|---|---|---|
| 4,607,656 A | | 8/1986 | Carter | |
| 4,779,635 A | * | 10/1988 | Lynch | 135/97 |
| 4,924,896 A | | 5/1990 | Carter | |
| 5,244,001 A | | 9/1993 | Lynch | |
| 5,421,356 A | | 6/1995 | Lynch | |
| 5,485,863 A | | 1/1996 | Carter | |
| 5,490,533 A | | 2/1996 | Carter | |
| 5,511,572 A | | 4/1996 | Carter | |
| 5,632,292 A | | 5/1997 | Carter | |
| 5,632,293 A | | 5/1997 | Carter | |
| 5,638,853 A | * | 6/1997 | Tsai | 135/145 |
| 5,701,923 A | * | 12/1997 | Losi et al. | 135/131 |
| 5,794,546 A | | 8/1998 | Carter | |
| 5,794,640 A | | 8/1998 | Jang | |
| 5,797,412 A | | 8/1998 | Carter | |
| 5,813,425 A | | 9/1998 | Carter | |
| 5,865,127 A | | 2/1999 | Carter | |
| 5,921,260 A | | 7/1999 | Carter | |
| 5,934,301 A | | 8/1999 | Carter | |
| 5,944,040 A | | 8/1999 | Jang | |
| 6,041,800 A | | 3/2000 | Carter | |
| 6,070,604 A | | 6/2000 | Carter | |
| 6,076,312 A | | 6/2000 | Carter | |
| 6,129,102 A | | 10/2000 | Carter | |
| 6,138,702 A | | 10/2000 | Carter | |
| 6,152,157 A | | 11/2000 | Jang | |
| 6,173,726 B1 | | 1/2001 | Talmadge | |
| 6,192,910 B1 | | 2/2001 | Carter | |
| 6,216,717 B1 | * | 4/2001 | Chen | 135/130 |
| 6,230,724 B1 | | 5/2001 | Lai | |
| 6,230,729 B1 | | 5/2001 | Carter | |

(Continued)

*Primary Examiner*—Robert Canfield
(74) *Attorney, Agent, or Firm*—Brooks Kushman P.C.

(57) ABSTRACT

A collapsible gazebo frame includes a set of four corner support members and a set of four scissor assemblies, each being coupled to a different pair of the four corner support members. Each of four scissor assembly sliders is slidingly coupled to a different one of the four corner support members and serves to extend and retract the scissor assemblies coupled to the respective corner support member when slid along the corner support member. A canopy support frame includes four canopy support members, each being coupled to the top end of a different one of the four corner support members and having a canopy frame joint. The canopy support frame also includes four canopy frame sliders, where each canopy frame slider is slidingly coupled to a different one of the four corner support members. The canopy frame sliders serve to lock the canopy frame joints when slid along their corner support members.

9 Claims, 3 Drawing Sheets

U.S. PATENT DOCUMENTS

| | | | | |
|---|---|---|---|---|
| 6,240,940 | B1 | 6/2001 | Carter | |
| 6,439,251 | B2 | 8/2002 | Carter | |
| 6,666,223 | B2 * | 12/2003 | Price et al. | 135/131 |
| 6,725,873 | B2 | 4/2004 | Liu | |
| 6,772,780 | B2 * | 8/2004 | Price | 135/131 |
| 6,779,538 | B2 * | 8/2004 | Morgante et al. | 135/128 |
| 6,874,520 | B2 | 4/2005 | Carter | |
| 6,899,112 | B2 * | 5/2005 | Tsai | 135/131 |
| 6,926,021 | B2 | 8/2005 | Carter | |
| 6,929,017 | B2 | 8/2005 | Byun | |
| 2003/0029490 | A1 * | 2/2003 | Price et al. | 135/131 |
| 2003/0164185 | A1 * | 9/2003 | Price | 135/131 |
| 2004/0250847 | A1 * | 12/2004 | Chiang | 135/131 |
| 2005/0178419 | A1 | 8/2005 | Tseng | |
| 2005/0229962 | A1 * | 10/2005 | Carter | 135/131 |
| 2005/0241688 | A1 * | 11/2005 | Wu | 135/145 |

* cited by examiner

COLLAPSIBLE GAZEBO FRAME WITH INDEPENDENT CANOPY SUPPORT

FIELD

The present invention relates to collapsible structures generally and more particularly to collapsible gazebos.

BACKGROUND

Collapsible gazebos may be used for many purposes such as providing shade or rain protection to allow for more enjoyable dining, resting or playing while in the outdoors. Additionally, because the gazebos are collapsible, the gazebos may be assembled and disassembled for use in different places, such as back yards or parks.

Conventional collapsible gazebos, however, can be difficult to assemble, detracting from the enjoyment of their use. For example, placing the canopy (tarp) over the top of an assembled gazebo frame can be difficult because the portion of the gazebo frame that supports the canopy (canopy support frame) is automatically deployed at the same time as the other parts of the gazebo frame are deployed. Thus, the canopy support frame is too high for many people to reach and the canopy cannot be properly placed on its frame.

Therefore, a gazebo frame allowing for easier deployment is needed.

SUMMARY

A collapsible gazebo frame with independent canopy support includes a set of four corner support members that rest on a ground surface at a bottom end and provide support for other gazebo frame components. The gazebo frame also includes a set of four scissor assemblies, each being coupled to a different pair of the four corner support members. The scissor assemblies can extend and retract. Each of a set of four scissor assembly sliders is slidingly coupled to a different one of the four corner support members and serves to extend and retract the scissor assemblies coupled to the respective corner support member when slid along the corner support member. As a further portion of the gazebo frame, a canopy support frame includes a set of four canopy support members, each being coupled to the top end of a different one of the four corner support members and having a canopy frame joint that can be placed in a locked position. The canopy support frame also includes a set of four canopy frame sliders, where each canopy frame slider is slidingly coupled to a different one of the four corner support members and is coupled to a different one of the four canopy support members by a canopy frame extender. The canopy frame sliders serve to lock the canopy frame joints when slid along their corner support members.

In one aspect of the invention, each of the four corner support members is extendable and retractable.

In another aspect of the invention, a canopy peak support member is coupled to the inner ends of each canopy support member to support the peak of a gazebo canopy.

In another aspect of the invention, each of a set of four feet is fixed to the bottom end of a different one of the four corner support members to anchor the gazebo frame to the ground surface.

In another aspect of the invention, each of the four corner support members slants inward towards the center of the gazebo frame when the gazebo frame is deployed.

In another aspect of the invention, the canopy frame joints are locked using canopy frame sleeves.

DETAILED DESCRIPTION

Figure 1:
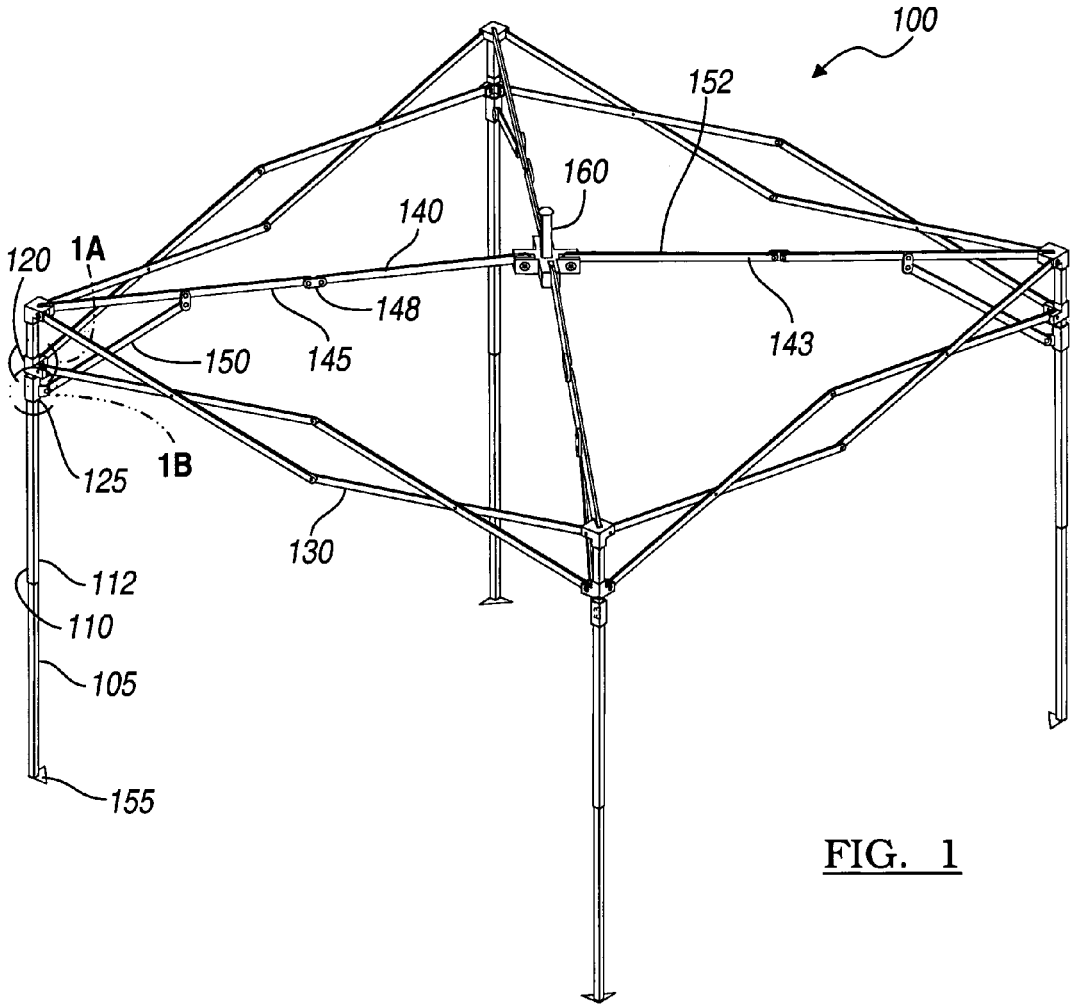
FIG. 1 is a perspective view showing the construction of a collapsible gazebo frame, according to one embodiment of the present invention.

FIG. 1 is a perspective view showing the construction of a collapsible gazebo frame 100, according to one embodiment of the present invention. The gazebo frame includes corner support members 112, scissor assemblies 130, scissor assembly sliders 120, and a canopy support frame 152. The canopy support frame includes canopy frame sliders 125, canopy support members 143, canopy frame joints 148, and canopy frame extenders 150. The canopy support members include outer canopy support members 145 and inner canopy support members 140. The gazebo frame may also include feet 155 to and a canopy peak support member 160. The corner support members may include upper corner support members 110 and lower corner support members 105.

Figure 1A:
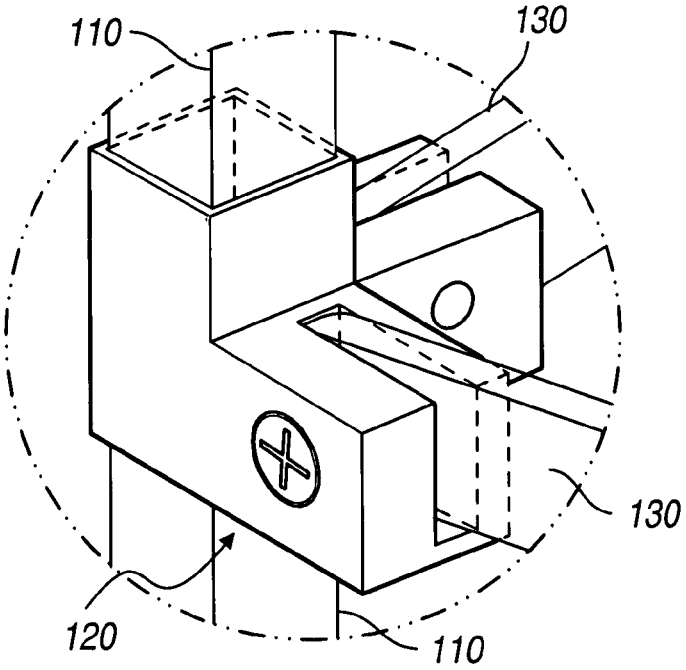
FIG. 1*a* is an enlarged perspective view of a slider of the collapsible gazebo frame of FIG. 1.
Figure 1B:
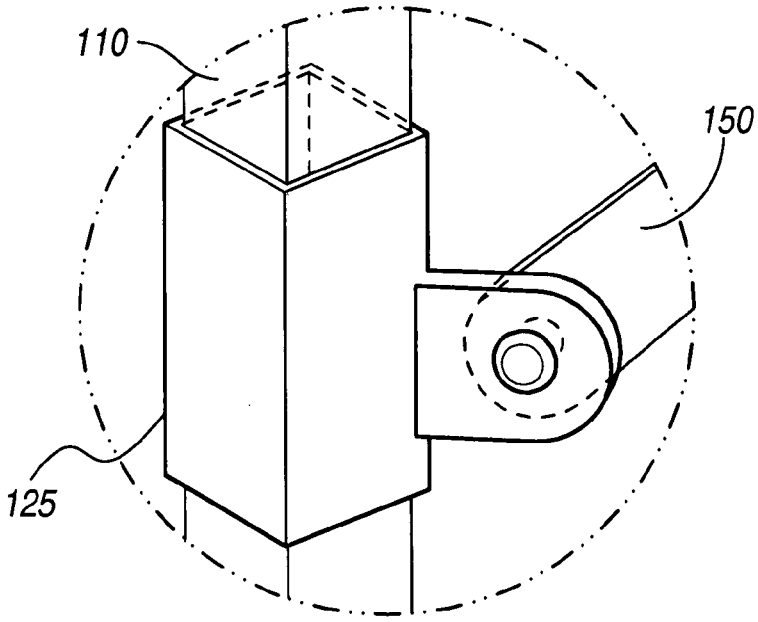
FIG. 1*b* is an enlarged perspective view of another slider of the collapsible gazebo frame of FIG. 1.

The corner support members 112 rest on the surface of the ground. The scissor assemblies 130 are each coupled to a different pair of corner support members and can be extended and retracted. Each of the scissor assembly sliders 120 are slidingly coupled a different corner support member as illustrated in FIGS. 1 and 1*a*. The scissor assembly sliders are used to extend and retract the scissor assemblies coupled to their respective corner support members. That is, by sliding a scissor assembly slider along its corner support member, a user can extend and retract the respective scissor assemblies.

In the canopy support frame 152, the canopy support members 143 are each coupled to a different corner support member. The canopy frame joints 148 which join the two portions of the canopy support members, the inner canopy support member 140 and the outer canopy support member 145, can be placed in a locked position to make the canopy support frame rigid. Each canopy frame slider 125 is slidingly coupled to a different corner support member. Each canopy frame slider is also coupled to a different canopy support member by the canopy frame extenders 150 as illustrated in FIGS. 1 and 1*a*. Upward movement of a given canopy frame slider causes the respective canopy frame extender to apply force to the respective canopy frame joint, thereby bringing the inner canopy support member and the outer canopy support member into linear alignment. The outer and inner canopy support members can be locked in linear alignment by locking the canopy frame slider in an upward position.

The embodiment depicted in FIG. 1 shows the gazebo frame in a deployed or extended position. In deploying the gazebo frame from a collapsed position, the canopy support frame 152 is deployed independently of the scissor assemblies 130. In one embodiment, the scissor assemblies are deployed by sliding the scissor assembly sliders 120 in an upward direction along the respective corner support members 112. Sliding of the scissor assembly sliders in an upward direction causes the scissor assemblies to extend from the corner support members. In one aspect, the scissor assembly sliders may be locked in an upward position using, for example, a push button latch in the corner support member. Locking the scissor assembly sliders in an upward position locks the scissor assemblies in an extended position, as shown in the embodiment depicted in FIG. 1. A further explanation of how the scissor assemblies are deployed can be found in U.S. Pat. No. 5,944,040.

The canopy support frame 152 is deployed independently of the scissor assemblies 130 using the canopy frame sliders 125. That is, the canopy frame sliders operate independent of the scissor assembly sliders. In one embodiment, upward movement of the canopy frame sliders causes the canopy frame extenders to exert force on the outer canopy support members. The force exerted on the outer canopy support members causes the canopy frame joints to come into a 'straight' position. In the straight position, the outer canopy support members are in linear alignment with respect to the inner canopy support members. In one aspect, the canopy frame joints can be locked in the straight position. The locking of the canopy frame joints may be achieved by locking the canopy frame sliders in an upward position using, for example, a lock mechanism such as a push button latch in the corner support member. By locking the canopy frame joints in a straight position, the canopy support members provide a rigid support structure upon which a canopy or tarp may be placed. Furthermore, since the canopy support frame is deployed independently of the scissor assemblies, the canopy may be placed over the canopy support frame after the scissor assemblies are extended to form the sides of the deployed gazebo frame but before the canopy support frame is deployed, elevating the peak of the gazebo frame and making it more difficult to place the canopy. Thus, the independent deployment of the canopy support frame provides for easier assembly and disassembly of the entire gazebo.

As stated above with respect to FIG. 1, the corner support members may include upper corner support members and lower corner support members. In one aspect, the upper and lower corner support members are telescoping with respect to each other, making the corner support members expandable and collapsible. Furthermore, in one aspect the corner support members are slanted inward toward the center of the gazebo frame when deployed to provide additional stability. Additionally, the feet 155 may be fixed to the bottom of the corner support members to rest on the surface of the ground and provide anchoring to the ground surface.

In another aspect, the canopy peak support member 160 provides additional height and support to the peak of the canopy.

Figure 2:
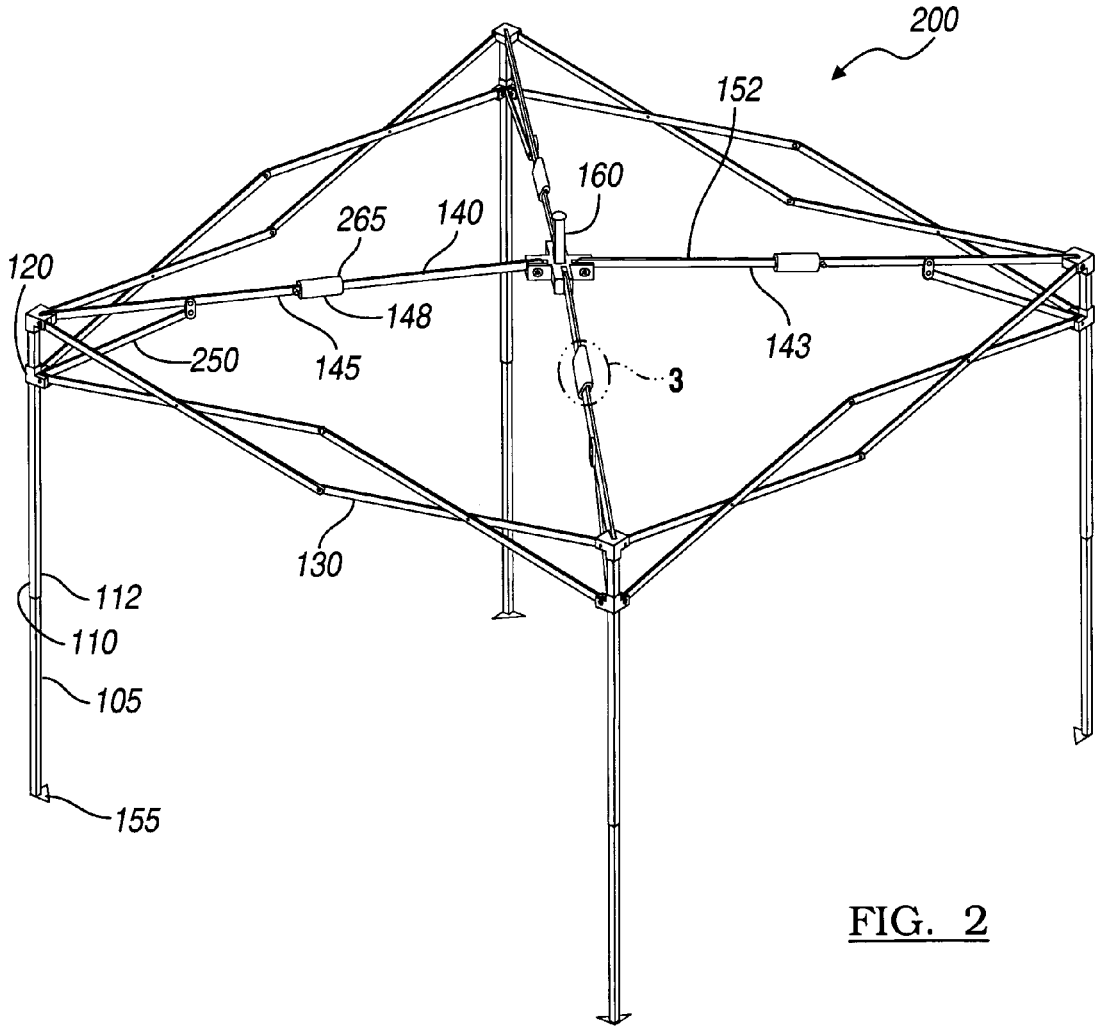
FIG. 2 is a perspective view showing the construction of a collapsible gazebo frame, according to another embodiment of the present invention.

FIG. 2 is a perspective view showing the construction of a collapsible gazebo frame 200, according to another embodiment of the present invention. The collapsible gazebo frame includes corner support members 112, scissor assemblies 130, scissor assembly sliders 120, and a canopy support frame 152. The canopy support frame includes canopy support members 143, canopy frame joints 148, canopy frame sleeves 265 and canopy frame extenders 250. The embodiment depicted in FIG. 2 provides an alternate mechanism for locking the canopy support frame in a deployed or extended position. The canopy frame sleeves 265 slidingly couple to the canopy support members. The canopy frame sleeves can be slid around the canopy frame joints to lock the canopy support members in a straight position. In one aspect, the canopy frame sliders described with reference to FIG. 1 are used in conjunction with the canopy frame sleeves described with reference to FIG. 2.

Figure 3:
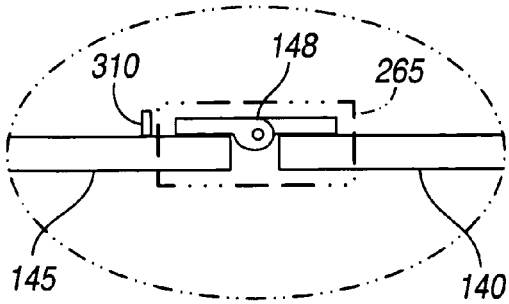
FIG. 3 is a detailed view showing a canopy frame sleeve, according to one embodiment of the invention.

FIG. 3 is a detailed view showing a canopy frame sleeve 265, according to one embodiment of the invention. The canopy frame sleeves may be of a hollow 'pipe-like' construction or of any other construction suitable to slidingly couple to the canopy support members. In the embodiment of FIG. 3, the canopy frame sleeve is depicted in a 'locked' position. That is, the canopy frame sleeve is slid around the canopy frame joint so that the inner canopy support member and the outer canopy support member are locked in a straight position. Furthermore, in the embodiment depicted in FIG. 3, a sleeve stop 310 prevents the canopy frame sleeve from sliding past the canopy frame joint. The sleeve stop may be a screw, a bolt, welded metal or any other suitable construction.

The present invention provides for easier assembly and disassembly of a gazebo frame by simplifying the assembly and disassembly of the canopy and canopy support frame.

Having disclosed exemplary embodiments and the best mode, modifications and variations may be made to the disclosed embodiments while remaining within the subject and spirit of the invention as defined by the following claims.

The invention claimed is:

1. A collapsible gazebo frame, comprising:

a set of four corner support members configured to rest on a ground surface at a bottom end and to provide support for other gazebo frame components;

a set of four scissor assemblies, each coupled to a different pair of the four corner support members and configured to extend and retract;

a set of four scissor assembly sliders, each scissor assembly slider being slidingly coupled to a different one of the four corner support members and configured to extend and retract the scissor assemblies coupled to the respective corner support member when slid along the corner support; and a canopy support frame comprising a set of four canopy support members, each coupled to the top end of a different one of the four corner support members and having a canopy frame joint configured to be placed in a locked position, and a set of four canopy frame sliders, each canopy frame slider being slidingly coupled to a different one of the four corner support members and coupled to a different one of the four canopy support members by a canopy frame extender, configured to lock the respective canopy frame joint when slid along the respective corner support member, wherein each canopy frame slider is slidingly coupled to the corresponding corner support member independent of the corresponding scissor assembly slider.

2. The collapsible gazebo frame of claim 1, wherein each of the four corner support members is extendable and retractable.

3. The collapsible gazebo frame of claim 1, further comprising a canopy peak support member coupled to inner ends of each canopy support member to support the peak of a gazebo canopy.

4. The collapsible gazebo frame of claim 1, further comprising a set of four feet, each foot fixed to the bottom end of a different one of the four corner support members to anchor the gazebo frame to the ground surface.

5. The collapsible gazebo frame of claim 1, wherein each of the four corner support members is configured to slant inward towards the center of the gazebo frame when the gazebo frame is deployed.

6. The collapsible gazebo frame of claim 1 wherein each canopy frame slider is separate from the corresponding scissor assembly slider.

7. The collapsible gazebo frame of claim 1 wherein each canopy frame slider is slidingly coupled to the corresponding corner support member below the corresponding scissor assembly slider so that each canopy frame slider may translate along the corresponding corner support member for extending the canopy frame extenders without being limited by the corresponding scissor assembly slider when the set of four scissor assemblies are extended.

8. The collapsible gazebo frame of claim 1 wherein each scissor assembly is coupled to each of the pair of corner support members at two spaced apart pivotal connections, and each canopy frame slider is slidingly coupled to the corresponding corner support member outboard of the scissor assembly pivotal connections.

9. A collapsible gazebo frame comprising:

a plurality of upright legs spaced about a perimeter of the gazebo frame;

a plurality of perimeter linkages each interconnecting sequential legs for collapsing and extending the plurality of legs and for supporting a perimeter of a canopy, each perimeter linkage having a link coupled to each of the corresponding sequential legs for pivoting relative to the respective leg, and each perimeter linkage having another link coupled to each of the sequential legs for pivoting relative to the respective leg and for translating along the length of the leg; and a plurality of center linkages each interconnected centrally within the perimeter of the gazebo frame and each connected to one of the legs for supporting the center of the canopy, each center linkage having a link coupled to the corresponding leg for pivoting relative to the leg, and each center linkage having another link coupled to the corresponding leg for pivoting relative to the respective leg and for translating along the length of the leg so that the canopy can be raised separately from the extending of the plurality of legs by the plurality of perimeter linkages.

* * * * *